US009206755B2

(12) United States Patent
Andersson

(10) Patent No.: US 9,206,755 B2
(45) Date of Patent: Dec. 8, 2015

(54) AIR/FUEL RATIO CONTROLLER AND CONTROL METHOD

(71) Applicant: Ingemar Andersson, Göteborg (SE)

(72) Inventor: Ingemar Andersson, Göteborg (SE)

(73) Assignee: Hoerbiger Kompressortechnik Holding GmbH, Vienna (AT)

( * ) Notice: Subject to any disclaimer, the term of this patent is extended or adjusted under 35 U.S.C. 154(b) by 648 days.

(21) Appl. No.: 13/685,790

(22) Filed: Nov. 27, 2012

(65) Prior Publication Data

US 2013/0138326 A1 May 30, 2013

(30) Foreign Application Priority Data

Nov. 30, 2011 (EP) ..... 11191364

(51) Int. Cl.
*F02D 41/14* (2006.01)

(52) U.S. Cl.
CPC ..... *F02D 41/1461* (2013.01); *F02D 41/1402* (2013.01); *F02D 41/1441* (2013.01); *F02D 41/1463* (2013.01); *F02D 41/1479* (2013.01)

(58) Field of Classification Search
CPC ..... F02D 41/146; F02D 41/1463; F02D 41/1486; F02D 41/1491; F02D 41/1475; F02D 41/1476; F02D 41/1441; F02D 14/1479
See application file for complete search history.

(56) References Cited

U.S. PATENT DOCUMENTS

| | | | | |
|---|---|---|---|---|
| 6,363,715 | B1 * | 4/2002 | Bidner | F02D 41/0235 60/274 |
| 6,389,803 | B1 * | 5/2002 | Surnilla | F01N 3/0842 205/781 |
| 6,434,930 | B1 * | 8/2002 | Cullen | F01N 3/0842 60/274 |
| 8,215,098 | B2 * | 7/2012 | Wang | F01N 3/0821 60/276 |
| 2002/0189236 | A1 * | 12/2002 | Hepburn | F02D 41/1462 60/276 |
| 2003/0010016 | A1 * | 1/2003 | Beer | F01N 11/00 60/274 |
| 2004/0209734 | A1 | 10/2004 | Mitsutani | |
| 2005/0022508 | A1 * | 2/2005 | Rosel | F01N 13/009 60/277 |
| 2008/0040018 | A1 * | 2/2008 | Katoch | F02D 13/0215 701/103 |
| 2011/0202230 | A1 * | 8/2011 | Sawada | B01D 53/9409 701/29.2 |
| 2013/0074817 | A1 * | 3/2013 | Fisher | F02M 21/0215 123/674 |

* cited by examiner

*Primary Examiner* — Hieu T Vo
*Assistant Examiner* — Sherman Manley
(74) *Attorney, Agent, or Firm* — Dykema Gossett PLLC

(57) ABSTRACT

An air/fuel ratio controller (6) and a method that uses an upstream control loop to maintain a given optimum air/fuel ratio ($\lambda_{opt}$), whereas the optimum air/fuel ratio ($\lambda_{opt}$) is determined in the controller (6) in an downstream control loop by adding incremental offset ($\Delta\lambda$) to the air/fuel ratio set-point ($\lambda_{SP}$) of an upstream control loop while monitoring a NOx sensor (10) output. The air/fuel ratio set-points ($\lambda_{SP}$) at two turning points (SP1, SP2) in the NOx sensor (10) output are used to calculate a new optimum air/fuel ratio set-point ($\lambda_{opt}$) as mean value of the air/fuel ratio set-points ($\lambda_{SP1}$, $\lambda_{SP2}$) at the turning points (SP1, SP2).

10 Claims, 2 Drawing Sheets

AIR/FUEL RATIO CONTROLLER AND CONTROL METHOD

FIELD OF THE INVENTION

The present invention relates to an air/fuel ratio controller and control method for an internal combustion engine equipped with a three-way-catalyst and with an oxygen sensor upstream the three-way-catalyst and a NOx sensor downstream the three-way-catalyst.

It is well known to use a three-way-catalyst (TWC) in the exhaust line of an internal combustion engine for cleaning the exhaust gas. In the TWC NOx is removed from the exhaust gas by reduction using CO, HC and $H_2$ present in the exhaust gas, whereas CO and HC is removed by oxidation using the $O_2$ present in the exhaust gas. A TWC works adequately only when the air/fuel ratio is kept in a rather narrow efficiency range near the stoichiometric air/fuel ratio. Therefore, an air/fuel ratio control is required in engines with a TWC.

THE PRIOR ART

There are many different control strategies for an air/fuel ratio control known from prior art. Also controls that use a sensor upstream of the catalyst and a sensor downstream the catalyst are known. In such controls the upstream sensor is usually used in an upstream feedback control to keep the air/fuel ratio close to the stoichiometric ratio whereas the downstream sensor is used in an downstream feedback control to provide a correction value for the upstream control loop in order to improve the accuracy of the air/fuel ratio control.

Such a control is described, e.g., in US 2004/0209 734 A1 which shows an air/fuel ratio control with an upstream air-fuel ratio sensor upstream a TWC and an oxygen sensor downstream the TWC. The air-fuel ratio sensor is used in a feedback control for controlling the amount of fuel fed to the engine so that the air-fuel ratio is near the stoichiometric air-fuel ratio. A sub-feedback control using the downstream oxygen sensor computes a correction value for the fuel amount in the feedback control.

U.S. Pat. No. 6,363,715 B1, on the other hand, describes an air/fuel ratio control with an oxygen sensor upstream the TWC for a primary control and an oxygen and NOx sensor downstream the TWC. A fuel correction value is computed on basis of the output of the NOx sensor by incrementing the fuel correction value to bias the air/fuel control towards a leaner air/fuel ratio. The fuel correction value is incremented in steps until the edge of an efficiency window of the TWC performance is reached which is detected by comparing the NOx sensor output to a predetermined threshold corresponding to the desired efficiency. The change in fuel correction value necessary to reach the window edge is used to correct the downstream oxygen sensor control set voltage to maintain the air/fuel ratio within a range such that the NOx conversion efficiency is maximized. This is done with the help of a lookup table that translates the number of increments necessary to reach the window edge in a correction term. Alternatively, the NOx sensor TWC window correction term is applied directly to the primary air/fuel control to modify the base fuel signal. As this method compares the sensor output to a predetermined threshold, i.e. an absolute value, it does not take into account the ageing of the catalyst. An ageing catalyst may lose some efficiency which could cause the control to fail in that the predetermined window edge cannot be found at all.

It is an object of the present invention to provide a simple but effective, stable and robust air/fuel control for engines equipped with a TWC that works over the complete lifetime of the catalyst.

SUMMARY OF THE INVENTION

According to the invention, a search for the AFR setpoint is performed in which the minimum NOx sensor output is reached. This is done with a simple but yet stable and robust control, where the system will calibrate itself. Furthermore, the invention provides robustness to ageing catalysts, in that it still finds the best operating AFR set-point. The method uses the combined properties of the combustion/catalyst/sensor in that the catalyst produces excess NH3 when the mixture is rich and the combustion produces excess NOx when the mixture is lean, whereas the sensor reacts on both species.

When a second oxygen sensor downstream of the three-way-catalyst is present, the direction of the first air/fuel ratio offset can easily determined by interpreting the oxygen sensor output as rich or lean region, whereas the air/fuel ratio offset is added in the rich direction if the output of the second oxygen sensor is interpreted as lean and vice versa.

Alternatively, the first air/fuel ratio offset is added in a predefined direction and the adding of the air/fuel ratio offset continues in the same direction if the NOx sensor output decreases or the adding of the air/fuel ratio offset continues in the opposite direction if the NOx sensor output increases. This allows a simple determination of the direction of the first air/fuel ratio offset even if no downstream oxygen sensor is available.

To ensure correct sensor readings and to improve the control quality it is advantageous that the output of the NOx sensor is allowed to stabilize for a certain time period before the next air/fuel ratio offset is added.

BRIEF DESCRIPTION OF THE DRAWINGS

The invention is described in the following with reference to the attached figures showing exemplarily preferred embodiments of the invention.

DETAILED DESCRIPTION OF THE PREFERRED EMBODIMENTS

Figure 1:
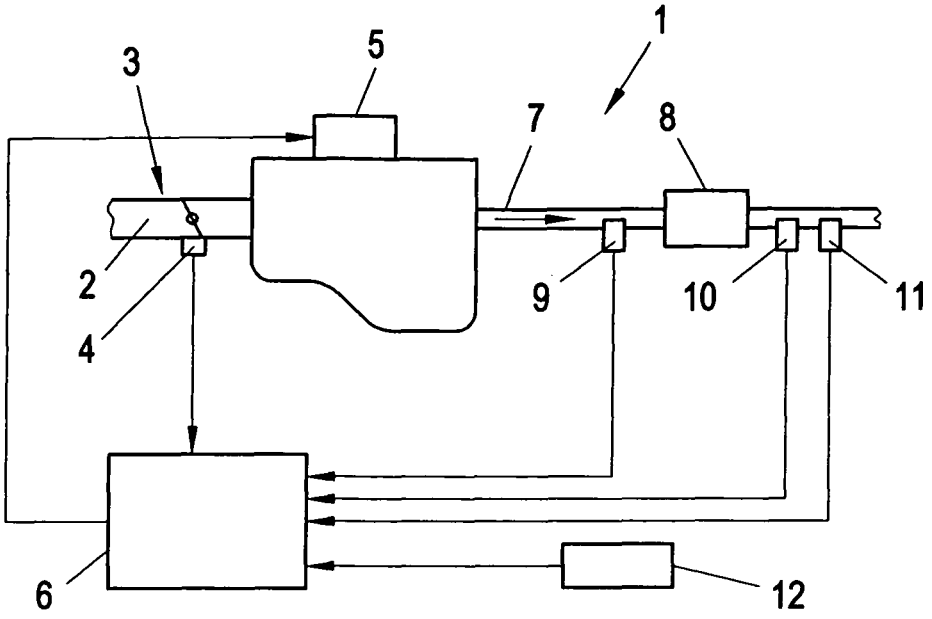
FIG. 1 shows an internal combustion engine equipped with a TWC and an inventive air/fuel ratio control.

FIG. 1 shows an internal combustion engine 1 in a schematic way. As is well known, in the engine 1 a number of cylinders (not shown) are arranged in which the combustion of air/fuel mixture takes place. Air is fed to the engine 1 via an air intake line 2 in which a throttle device 3 is arranged that is controlled, e.g., by a gas pedal (not shown) or any other engine control device. The position of the throttle device may be detected by a throttle sensor 4. A fuel metering device 5 is arranged on the engine 1 which controls the amount of fuel fed to the cylinders and which is controlled by a controller 6, e.g., an ECU (engine control unit). The controller 6 calculates the optimum set-point air-fuel ratio $\lambda_{SP}$ which an upstream control loop executes through operation of the fuel metering device 5 and feedback from the upstream oxygen sensor 9. The controller 6 and/or the upstream control loop that is implemented in the controller 6 may take into account the current engine 1 operation conditions, e.g., as measured by further sensors 12 on the engine 1, for its operation.

The fuel metering device 5 may also be arranged directly on the intake line 2, as is well known. Moreover, it is also known to supply fuel directly into the cylinders, i.e., with direct injection.

In the exhaust line 7 a three-way-catalyst (TWC) 8 is arranged for cleaning the exhaust gas by removing NOx, CO and HC components. The operation and design of a TWC 8 is well known and is for that reason not described here in detail.

Figure 2A:
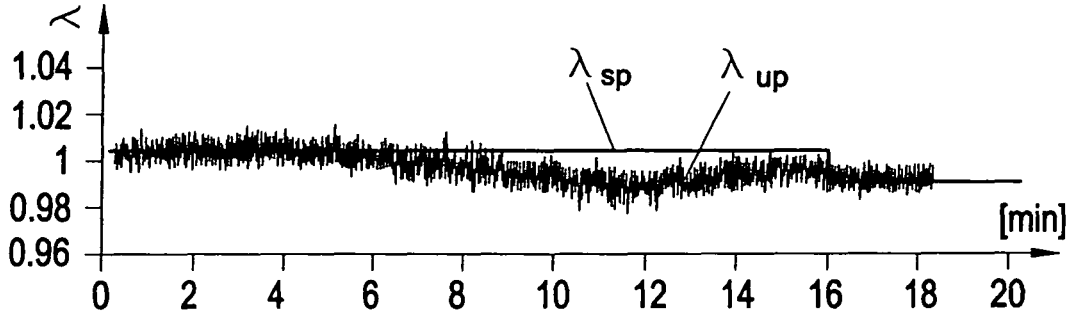
FIGS. 2*a*-2*d* depict a first embodiment of the inventive method, FIG. 2*a* showing an upstream lambda measurement delivered by an upstream oxygen sensor and a set optimum air/fuel ratio set-point, FIG. 2*b* showing setting the current upstream air/fuel ratio set-point of an upstream control loop, FIG. 2*c* showing the NOx sensor output whilst varying the current air/fuel ratio set-point, and FIG. 2*d* showing an enlarged view of the NOx sensor output.
Figure 2B:
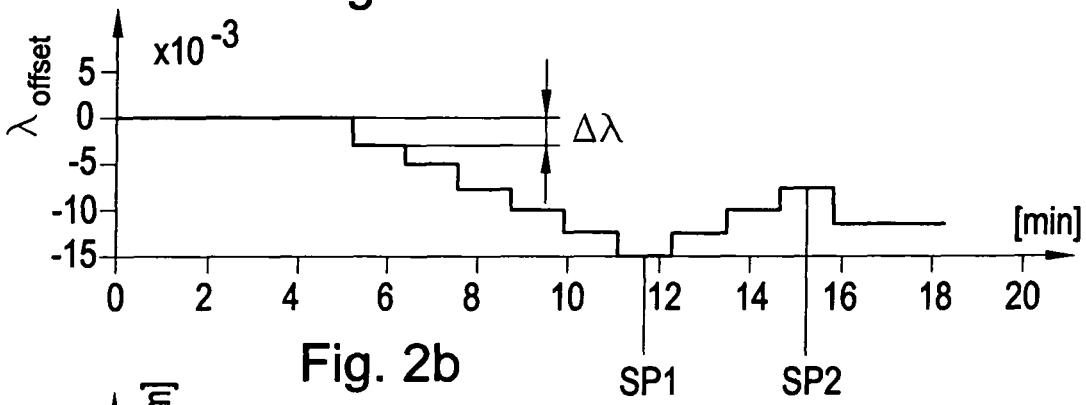

Upstream of the TWC 8 an upstream oxygen sensor 9 is arranged that measures the $O_2$ concentration in the exhaust gas before the TWC 8. The measurement $\lambda_{up}$ of the upstream oxygen sensor 9 is shown in FIG. 2*a*. Downstream of the TWC 8 a NOx sensor 10 is arranged in the exhaust line 7 that responds preferably to both NOx and $NH_3$. Furthermore, a second downstream oxygen sensor 11 may also be present in the exhaust line 7 downstream the TWC 8. The sensor outputs are read and processed by the controller 6 as described in the following. There might also be arranged further sensors 12 on the engine, e.g., an air intake temperature sensor, a cylinder pressure sensor, a crank angle sensor, an engine speed sensor, a coolant sensor, etc., whose outputs may also be read and processed by the controller 6.

Figure 2C:
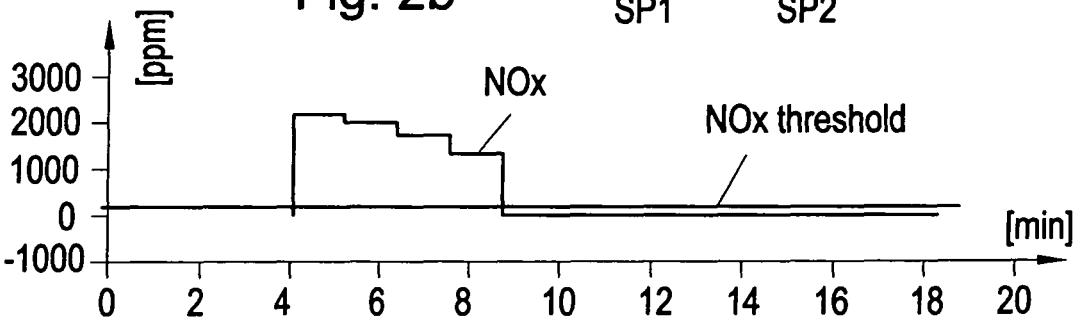
Figure 2D:
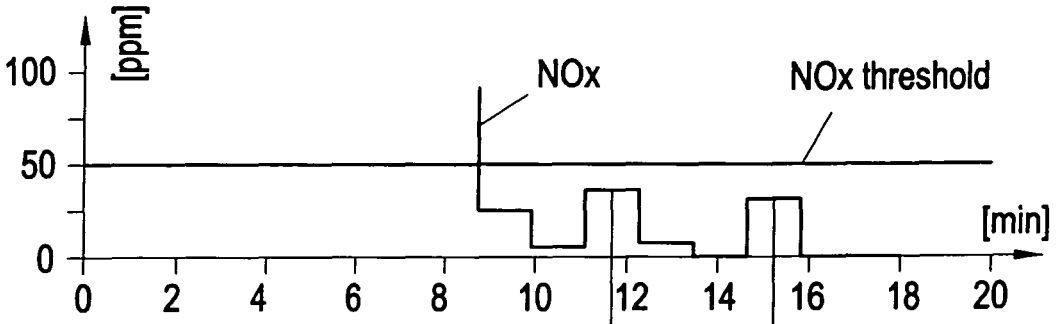

With reference to FIGS. 2*a*-2*d*, a first embodiment of an inventive air/fuel ratio control for the engine 1 is described in the following. The engine 1 is operated with an optimum air/fuel ratio set-point $\lambda_{SP}$, e.g., air/fuel ratio set-point $\lambda_{SP}$=1.005 and an upstream lambda measurement $\lambda_{up}$ is delivered by the upstream oxygen sensor 9, as shown in FIG. 2*a*. After about four minutes the downstream NOx sensor 10 outputs a NOx value above a certain predefined NOx threshold, e.g., 50 ppm, as shown in FIG. 2*c*. The reason for this could be a drift in the upstream oxygen sensor 9 due to ageing or contamination leading to wrong air/fuel ratio setpoints $\lambda_{SP}$ calculated by the upstream control loop, or a changed fuel quality that affects the catalyst conversion chemistry. This increase triggers the downstream control loop in the controller 6 for computing a new optimum air/fuel ratio set-point $\lambda_{SP}$ for the upstream control loop. By the downstream control loop an air/fuel ratio offset $\Delta\lambda$ (FIG. 2*b*), e.g., a value $\Delta\lambda$=0.0025, is added to the current upstream air/fuel ratio set-point $\lambda_{SPC}$ of the upstream control loop (starting at the optimum air/fuel ratio set-point $\lambda_{SP}$, i.e., $\lambda_{SPC}=\lambda_{SP}$). In the present example the air/fuel ratio offset $\Delta\lambda$ is first added in the richer direction, e.g., the current air/fuel ratio set-point $\lambda_{SPC}$ is incrementally reduced by the air/fuel ratio offset $\Delta\lambda$, which is done whilst monitoring the NOx sensor 10 output (FIG. 2*c*). This increment decreases the NOx output as is shown in FIG. 2*c*. The adding of the air/fuel ratio offset $\Delta\lambda$ is repeated in the same (here richer) direction until a turning point is reached in the NOx sensor 10 output, i.e., until (in the given example) the NOx output starts to increase again due to the excess $NH_3$ produced by the catalyst when operated with a rich mixture. This happens in the given example after about eleven minutes, which is best seen in FIG. 2*d*, showing the NOx sensor 10 output in detail. The current upstream air/fuel ratio set-point $\lambda_{SPC}$ at this first turning point SP1 is stored in the controller 6 as first air/fuel ratio set-point boundary value $\lambda_{SP1}$, e.g., $\lambda_{SP1}$=0.99 (in the example of FIG. 2*b* $\lambda_{SP1}=\lambda_{SP}-6\cdot(\Delta\lambda)$).

Now the air/fuel ratio offset $\Delta\lambda$ is incrementally added to the current air/fuel ratio set-point $\lambda_{SPC}$ (starting at the first air/fuel ratio set-point boundary value $\lambda_{SP1}$) in the opposite direction, in the given example in the leaner direction, by increasing the current air/fuel ratio set-point $\lambda_{SPC}$ by the air/fuel ratio offset $\Delta\lambda$, which causes the NOx sensor 10 output to decrease again. This is repeated until a second turning point SP2 is reached again in the NOx sensor 10 output, i.e., until (in the given example) the NOx output starts to increase again, which is reached after about fourteen minutes in the example of FIG. 2*d*. The current upstream air/fuel ratio set-point $\lambda_{SPC}$ at this second turning point SP2 is stored in the controller 6 as second air/fuel ratio set-point boundary value $\lambda_{SP2}$, e.g., $\lambda_{SP2}$=0.9975 (here $\lambda_{SP2}=\lambda_{SP1}+3\cdot(\Delta\lambda)$).

The downstream control loop computes now a new optimum air/fuel ratio set-point $\lambda_{SP}$ as mean value of the first and second air/fuel ratio set-point boundary value $\lambda_{SP1}$ and $\lambda_{SP2}$, $$\lambda_{opt} = \frac{\lambda_{SP1} + \lambda_{SP2}}{2}.$$

In the present example the new optimum air/fuel ratio set-point $\lambda_{SP}$ would be calculated as 0.99375 or rounded to 0.994. The new optimum air/fuel ratio set-point $\lambda_{SP}$=0.994 is then used in the controller 6 as set-point for the upstream air/fuel ratio control loop (see FIG. 2*a*) until a new downstream control is triggered again, i.e., until the NOx output exceeds the set threshold again.

It would of course also be possible to perform more than one of the above set-point adjustment cycles. The new optimum air/fuel ratio set-point $\lambda_{SP}$ could then be calculated as overall mean value of the optimum air/fuel ratios $\lambda_{SP}(i)$ of the single adjustment cycles i, e.g., $$\lambda_{SP} = \frac{1}{i}\sum_{i} \lambda_{SP}(i).$$

It is of course possible to use any other mean value for the calculation of the new optimum air/fuel ratio $\lambda_{SP}$, e.g., a geometric mean value, a harmonic mean value, quadratic mean value, etc., instead of an arithmetic mean value.

The first and second air/fuel ratio set-point boundary value $\lambda_{SP1}$ and $\lambda_{SP2}$ can be stored in the controller 6 or in a dedicated storage device in data communication with the controller 6.

It is advantageous to let the exhaust gas stabilize for a certain time period, e.g., about for one minute as in the given example, each time before the next air/fuel ratio offset $\Delta\lambda$ is added to the current air/fuel ratio set-point $\lambda_{SPC}$. This ensures correct sensor readings and improves the control quality.

If a downstream oxygen sensor 11 (or equivalently a downstream lambda sensor) is present, the output of the oxygen sensor 11 can be used to determine the direction of the first incremental air/fuel ratio offset $\Delta\lambda$ in the downstream control loop. As is known, the output of the oxygen sensor 11 can be interpreted into a rich or lean region. If the output of the downstream oxygen sensor 11 indicates lean conditions, the direction of the first air/fuel ratio offset $\Delta\lambda$ is set to rich, and vice versa.

Figure 3A:
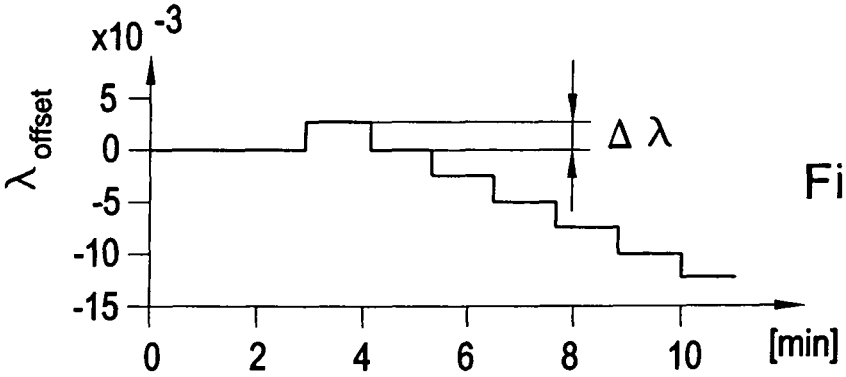
FIGS. 3*a*-3*b* depict a second embodiment of the inventive method, FIG. 3*a* showing setting the current upstream air/fuel ratio set-point of an upstream control loop, and FIG. 3*b* showing the NOx sensor output whilst varying the current air/fuel ratio set-point.
Figure 3B:
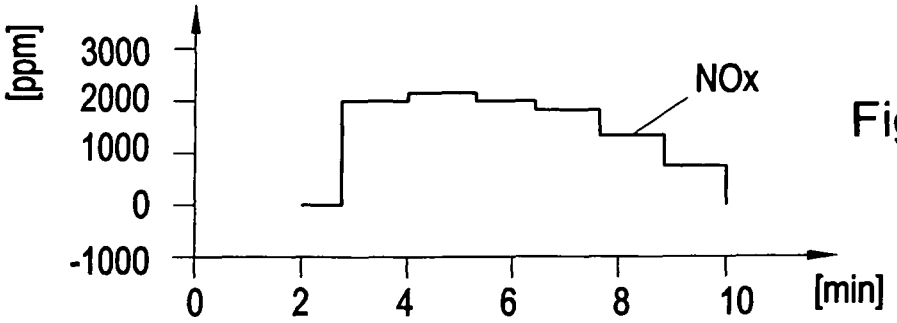

The direction of the first incremental air/fuel ratio offset $\Delta\lambda$ can also be determined without downstream oxygen sensor 11. For that, the air/fuel ratio offset $\Delta\lambda$ is added in a predefined direction, e.g., here in lean direction by adding the air/fuel ratio offset $\Delta\lambda$, as shown in FIG. 3*a*. If the NOx output decreases, the incremental adding of the air/fuel ratio offset $\Delta\lambda$ continues in the same direction. If the NOx output increases, as in FIG. 3*b*, adding the air/fuel ratio offset $\Delta\lambda$ starts in the opposite direction, i.e., in FIG. 3*a* by subtracting the air/fuel ratio offset $\Delta\lambda$. The search for the optimum air/fuel ratio set-point $\lambda_{SP}$ continues then as described with reference to FIGS. 2*a*-2*d*.

The search for the optimum air/fuel ratio set-point $\lambda_{SP}$ may also be triggered manually or by the controller 6, e.g., every x hours, to maintain high efficiency of the catalyst 8. This could be done by changing the optimum air/fuel ratio set-point $\lambda_{SP}$ to simulate a drift in the upstream lambda sensor causing the NOx sensor output to exceed the predefined threshold and thereby triggering the downstream control loop.

The invention claimed is:

1. An air/fuel ratio control method for an internal combustion engine (1) equipped with a three-way-catalyst (8) and with an oxygen sensor (9) upstream the three-way-catalyst (8) and a NOx sensor (10) downstream the three-way-catalyst (8), whereas the output ($\lambda_{up}$) of the upstream oxygen sensor (9) is used in an upstream control loop that controls the air/fuel ratio by maintaining a certain optimum upstream air/fuel ratio set-point ($\lambda_{SP}$), the method comprising the steps of:

adding incremental offsets ($\Delta\lambda$) to the upstream air/fuel ratio set-point ($\lambda_{SP}$) to get a current air/fuel ratio set-point ($\lambda_{SPC}$) while the NOx sensor (10) output is monitored, repeatedly adding incremental offsets ($\Delta\lambda$) until a first turning point (SP1) in the NOX sensor (10) output is reached and storing the current air/fuel ratio set-point ($\lambda_{SPC}$) at the first turning point (SP1) as first air/fuel ratio set-point boundary value ($\lambda_{SP1}$), adding incremental offsets ($\Delta\lambda$) to the current upstream air/fuel ratio set-point ($\lambda_{SPC}$) in the opposite direction while the NOx sensor (10) output is monitored, repeatedly adding incremental offsets $\Delta\lambda$ in the opposite direction until a second turning point (SP2) in the NOx sensor (10) output is reached again and storing the current air/fuel ratio set-point ($\lambda_{SPC}$) at the second turning point (SP2) as second air/fuel ratio set-point boundary value ($\lambda_{SP2}$), and calculating a new optimum air/fuel ratio set-point ($\lambda_{SP}$) for the upstream control loop as mean value of the first and second air/fuel ratio set-point boundary values ($\lambda_{SP1}$, $\lambda_{SP2}$).

2. The method of claim 1, wherein the output of a second oxygen sensor (11) downstream of the three-way-catalyst (8) is interpreted as rich or lean and the first air/fuel ratio offset ($\Delta\lambda$) is added in the rich direction if the output of the second oxygen sensor (11) is interpreted as lean and vice versa.

3. The method of claim 1, wherein the first air/fuel ratio offset ($\Delta\lambda$) is added in a predefined direction and the adding of the air/fuel ratio offset ($\Delta\lambda$) continues in the same direction if the NOx sensor (10) output decreases, or the adding of the air/fuel ratio offset ($\Delta\lambda$) starts in the opposite direction if the NOx sensor (10) output increases.

4. The method according to claim 1, wherein the output of the NOx sensor (10) is allowed to stabilize for a certain time period before the next air/fuel ratio offset ($\Delta\lambda$) is added.

5. The method according to claim 1, wherein the determination of the optimum air/fuel ratio ($\lambda_{SP}$) is repeated for a given number of times (i) and the new optimum air/fuel ratio ($\lambda_{SP}$) is calculated as mean value of the number of times (i) optimum air/fuel ratios ($\lambda_{SP}$(i)).

6. An air/fuel ratio controller for an internal combustion engine (1) with a three-way-catalyst (8) arranged in an exhaust line (7) of the engine (1) and with an oxygen sensor (9) upstream the three-way-catalyst (8) and a NOx sensor (10) downstream the three-way-catalyst (8), whereas the controller (6) uses the output ($\lambda_{up}$) of the upstream oxygen sensor (9) in an upstream control loop to maintain a certain optimum air/fuel ratio set-point ($\lambda_{SP}$), whereas incremental offsets ($\Delta\lambda$) are added to the upstream air/fuel ratio set-point ($\lambda_{SP}$) to get a current air/fuel ratio set-point ($\lambda_{SPC}$) while the NOx sensor (10) output is monitored, the incremental offsets ($\Delta\lambda$) are repeatedly added until a first turning point (SP1) in the NOX sensor (10) output is detected and the current air/fuel ratio set-point ($\lambda_{SPC}$) at the first turning point (SP1) is stored as first air/fuel ratio set-point boundary value ($\lambda_{SP1}$), incremental offsets ($\Delta\lambda$) to the current upstream air/fuel ratio set-point ($\lambda_{SPC}$) are added in the opposite direction while the NOx sensor (10) output is monitored, incremental offsets ($\Delta\lambda$) are repeatedly added in the opposite direction until a second turning point (SP2) in the NOx sensor (10) output is reached again and the current air/fuel ratio set-point ($\lambda_{SPC}$) at the second turning point (SP2) is stored as second air/fuel ratio set-point boundary value ($\lambda_{SP2}$), and a new optimum air/fuel ratio set-point ($\lambda_{SP}$) for the upstream control loop is calculated in the controller (6) as mean value of the first and second air/fuel ratio set-point boundary values ($\lambda_{SP1}$, $\lambda_{SP2}$).

7. The air/fuel ratio controller of claim 6, wherein the output of a second oxygen sensor (11) arranged downstream of the three-way-catalyst (8) is interpreted by the controller (6) as rich or lean and the first air/fuel ratio offset ($\Delta\lambda$) is added in the rich direction if the output of the second oxygen sensor (11) is interpreted as lean and vice versa.

8. The air/fuel ratio controller of claim 6, wherein the first air/fuel ratio offset ($\Delta\lambda$) is added in a predefined direction and the adding of the air/fuel ratio offset ($\Delta\lambda$) continues in the same direction if the NOx sensor (10) output decreases, or the adding of the air/fuel ratio offset ($\Delta\lambda$) continues in the opposite direction if the NOx sensor (10) output increases.

9. The air/fuel ratio controller of claim 6, wherein the output of the NOx sensor (10) is allowed to stabilize for a certain time period before the next air/fuel ratio offset ($\Delta\lambda$) is added.

10. The air/fuel ratio controller of claim 6, wherein the controller (6) determines the optimum air/fuel ratio set-point ($\lambda_{SP}$) a given number of times (i) and the new optimum air/fuel ratio set-point ($\lambda_{SP}$) is calculated in the controller (6) as mean value of the number of times (i) optimum air/fuel ratio set-points ($\lambda_{SP}$(i)).

* * * * *